United States Patent [19]

Mohler

[11] Patent Number: 5,046,204

[45] Date of Patent: Sep. 10, 1991

[54] INFANT WRAPPING ARTICLE

[76] Inventor: Steven Mohler, 1020 E. Chestnut Ave., Santa Ana, Calif. 92701

[21] Appl. No.: 671,101

[22] Filed: Mar. 18, 1991

[51] Int. Cl.[5] ..... A47G 9/08

[52] U.S. Cl. ..... 5/413; 5/494; 2/69; 2/69.5

[58] Field of Search ..... 2/69, 69.5; 5/413, 494

[56] References Cited

U.S. PATENT DOCUMENTS

| | | | |
|---|---|---|---|
| 1,584,853 | 5/1926 | Dern | 2/69 |
| 1,723,644 | 8/1929 | Collingbourne | 2/69.5 |
| 2,441,745 | 5/1948 | Benamy | 2/69 |
| 2,743,451 | 5/1956 | Meyers | 2/69.5 X |
| 3,034,132 | 5/1962 | Landsberger et al. | 2/69.5 |
| 3,412,407 | 11/1968 | Key | 2/69.5 |
| 4,611,353 | 9/1986 | Als et al. | 2/69 |
| 4,897,885 | 2/1990 | Lunt | 2/69.5 |

*Primary Examiner*—Michael F. Trettel

*Attorney, Agent, or Firm*—Gary Appel

[57] ABSTRACT

An article for wrapping an infant comprises a sheet of fabric material, such as blanket material, quilting or baby bunting, having a generally triangular left-hand, a generally triangular right-hand side flap, first and second botties or stocking feet depending from lower regions of the sheet for receiving the feet of an infant resting along a vertical central region of the sheet, and a hood in upper regions of the sheet for receiving the head of the infant. The side flaps each have a sufficient sideward length to enable the flaps to wrap sidewardly over the infant when it is resting along the vertical center region of the sheet and to overlap one another by a substantial amount. The article includes strips of hook and loop fabric for releasably securing the side flaps together when they are in the overlapped condition. The sheet is sized so that an infant resting along the vertical region of the sheet can have its head in the hood and its feet in the booties or stocking feet.

5 Claims, 2 Drawing Sheets

INFANT WRAPPING ARTICLE

BACKGROUND OF THE INVENTION

1. Field of the Invention

The present invention relates generally to the field of infant blankets and wraps, and, more particularly, to infant blankets and wraps of the type commonly used to wrap infants at hospitals, nurseries and at home when an infant is to be kept warm, carried about or taken outside.

2. Background Discussion

As is well known, it is commonplace for an infant to be wrapped in a small blanket when the infant is carried around. Wrapping an infant in this manner not only keeps the infant warm, but also helps confine the infant, making it easier to handle and carry and reduces the risk of injury to the infant.

In such cases, the infant is generally placed on an open, generally rectangular blanket. The lower end of the blanket is then folded up over the legs and lower body of the infant; then side regions of the blanket are folded sidewardly over and around the baby in an overlapping manner. To hold the blanket wrapped around the infant, large safety pins—known as blanket pins—are used. The blanket is thereby folded and held into a semblance of a large envelope in which the baby is enfolded.

Alternatively, a sewn, pre-shaped article, formed into the shape of a small sleeping bag, may be used for "wrapping" an infant. In such case, the infant may be slid downwardly into the closed article or, as is more common and easier to use, the article is unzippered, the infant placed inside, and the article is zippered closed.

Such heretofore known types of infant wrapping articles have, however, various disadvantages or drawbacks. Regular infant blankets are awkward to fold neatly and usually end up, in the folded condition, bulky and unattractive. Moreover, the blanket pins commonly used for holding blankets in the folded condition are dangerous to use around infants who may either be injured by the pins when the blanket is being pinned or by an infant using the pin as a toy. Still further, if the blanket is not properly pinned together, there is a danger that the bottom flap will open and the infant slide downwardly through the blanket and fall on the floor or other hard surface. On the other hand, sleeping bag-types of infant wraps are also often difficult to use, even when equipped with a zipper, as infants are likely to squirm and twist while being wrapped. Furthermore, even when used carefully, the zippers on such wraps may catch an infant's skin and cause injury.

For these and other reasons, improved articles for wrapping infants are still needed, and it is a principal objective of the present invention to provide such an improved infant wrap.

SUMMARY OF THE INVENTION

In accordance with the present invention-n, there is provided an infant wrapping article which comprises a sheet of fabric material having a left-hand side flap, a right-hand side flap, foot means formed at or connected to lower regions of the sheet for receiving the feet of an infant, and hood means formed at or connected to upper regions of the sheet for receiving and partially covering the head of an infant wrapped in the article. The side flaps of the article each have a sufficient sideward length to enable the flaps to wrap sidewardly over an infant resting along a vertical center region of the sheet and to overlap one another by a substantial amount Included are means, such as strips of hook and loop fabric, for releasably securing the side flaps together when they are in the overlapped condition.

According to a preferred embodiment of the invention, the left-hand and right-hand side flaps are generally triangular in shape, and are transversely aligned with one another. Further in accordance with the preferred embodiment, the means for receiving the feet of an infant comprise first and second booties or stocking feet, each of which is configured for receiving a foot portion of an infant resting along the vertical center region of the sheet. The article is sized so that an infant resting along said vertical region of the sheet can have its head in the hood means part of the article and its feet in the foot means.

Preferably the article is made from a soft fabric such as blanket material, quilting or bunting so as to keep an infant wrapped in the article warm and at least somewhat cushioned. The article is easy to make and use and after an infant is wrapped in the article with its head in the hood and its feet in the booty portion of the article, it does not have a tendency to slip downwardly or upwardly from the article.

BRIEF DESCRIPTION OF THE DRAWINGS

The present invention can be more readily understood from a consideration of the following detailed description when taken in conjunction with the accompanying drawings, in which.

In the various FIGS. like elements and features are given the same reference number and/or other identification.

DESCRIPTION OF THE PREFERRED EMBODIMENT

Figure 1:
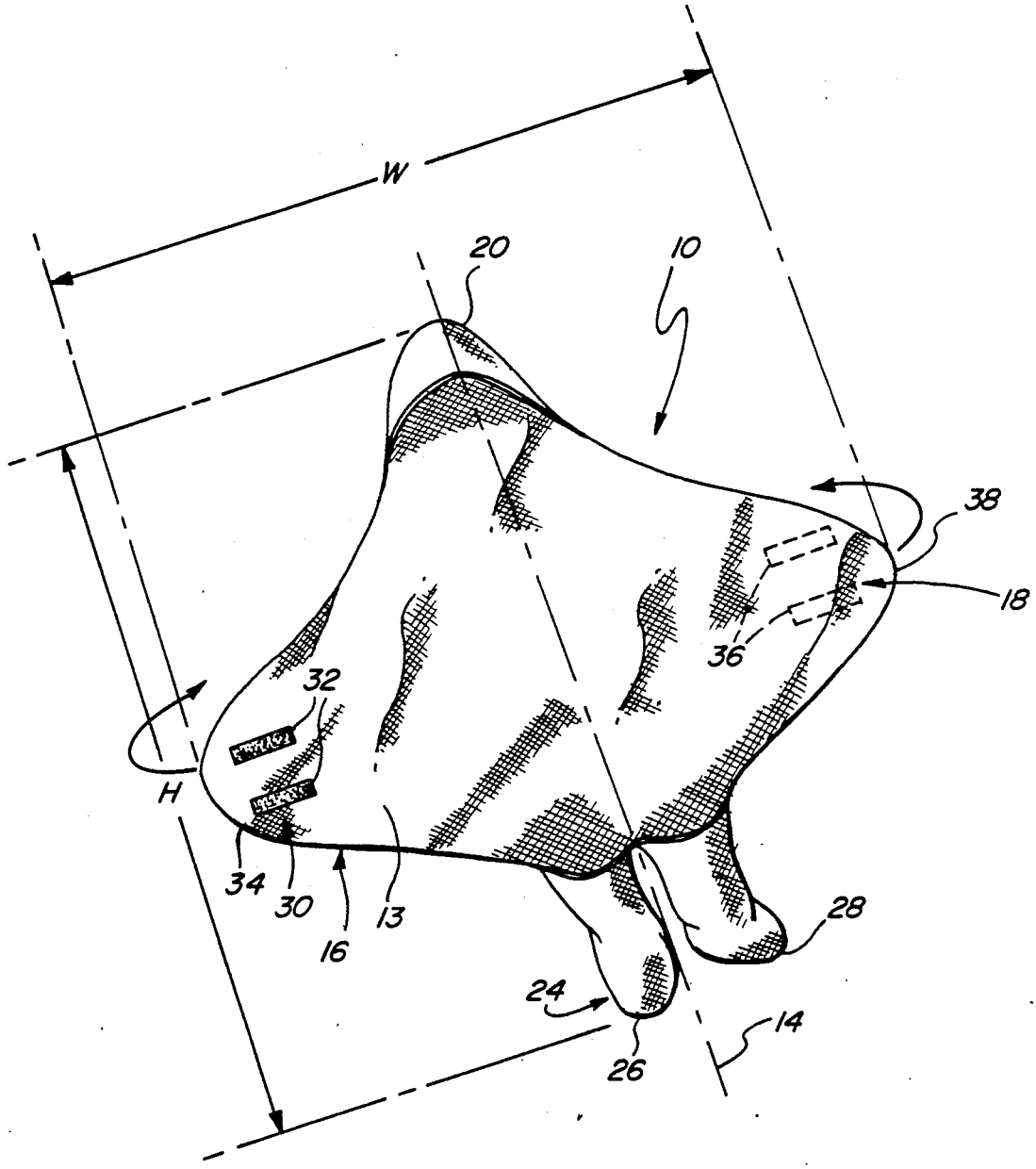
FIG. 1 is a perspective drawing of an infant wrapping article in accordance with the present invention, showing the article in its open, generally flat condition and showing an infant hood portion in upper regions of the article and a pair of depending infant foot receiving bootie portions at lower regions of the article.
Figure 2:
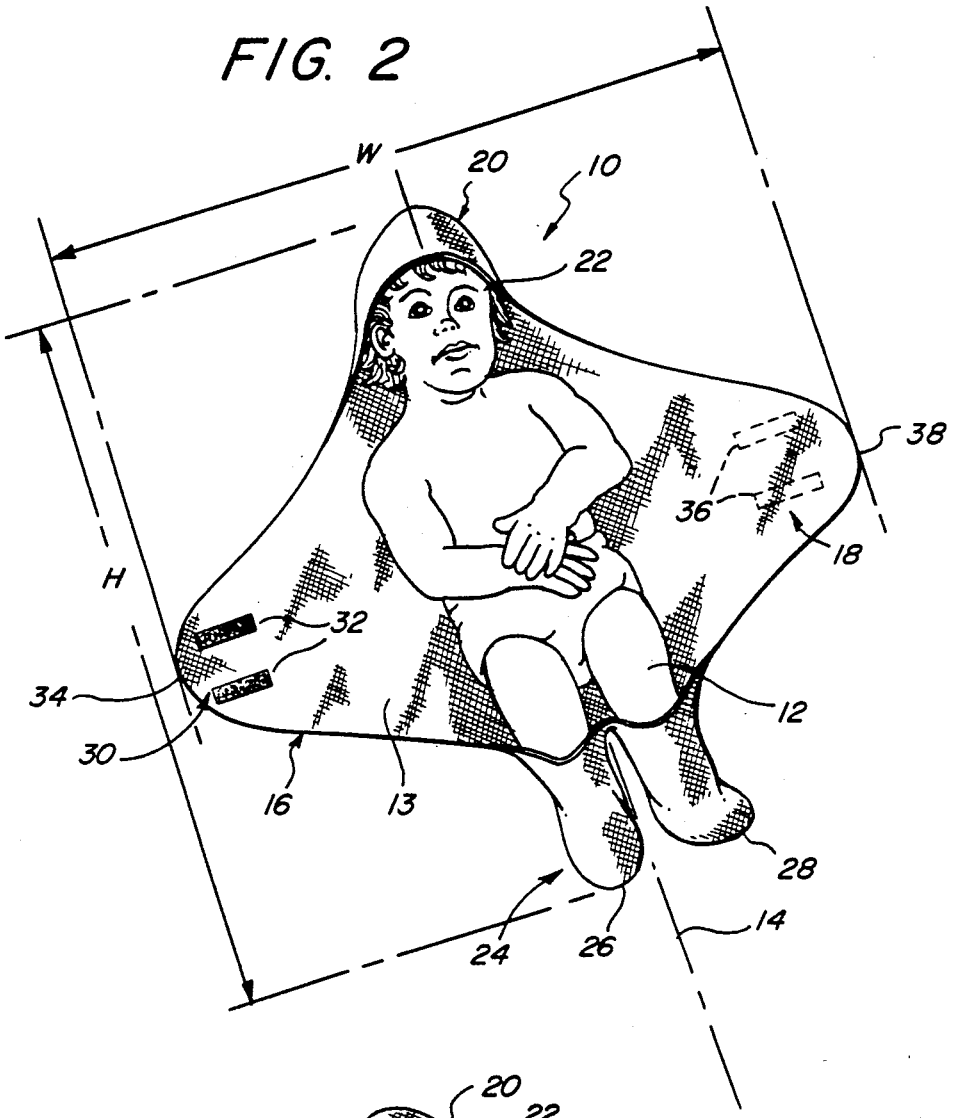
FIG. 2 is a perspective drawing similar to FIG. 1, but showing an infant lying on the article with its head in the hood portion and its feet in the bootie portion; and, FIG. 3 is a perspective drawing showing an infant completely wrapped in the infant wrapping article of FIGS. 1 and 2.
Figure 3:
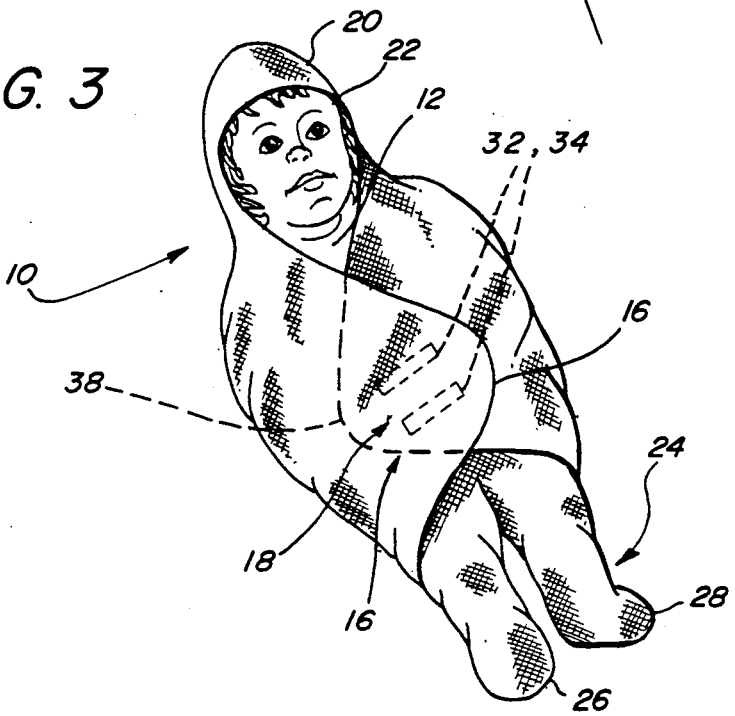

There is shown in FIG. 1 an infant wrapping article 10 in accordance with the present invention. As shown, infant wrapping 10 generally comprises a roughly square or diamond shaped sheet of fabric which may be formed of a material such as blanket cloth, quilting, mattress padding, heavy weight flannel or fleecy material which will more or less retain its shape and enable the article to stay in place around a wrapped infant 12 (FIGS. 2 and 3). Preferably, the fabric from which article 10 is made is of a reasonable weight so as to keep a wrapped infant warm, and is of an easily launderable type.

Infant wrapping article 10 is particularly formed, in a generally square or diamond shape to enable easy and effective wrapping of infant 12 and is particularly designed to keep the infant from sliding or falling out of the article after her or she has been wrapped therein. To this end, wrapping article 10, which is preferably constructed of a flat sheet 13 of such a material as blanket material, baby bunting, quilting, or combinations thereof, as shown in FIGS. 1 and 2, when laid flat, is symmetrical about a vertical centerline of symmetry 14, having respective left-hand and right-hand, generally triangular-shaped side fold-over or flap portions 16 and 18. The vertical height, H, of article 10 (that is, the head-to-toe height) is about a typical height (length) of an infant, and the article may be provided in different sizes for infants of different ages and sizes. The side-to-side width, W, of article 10, from tip-to-tip of side flap portions 16 and 18 is sufficient, relative to article height, H, to enable flap portions to fold inwardly toward centerline 14 and sidewardly to substantially overlap one another when infant 12 is wrapped therein, as depicted in FIG. 3.

Infant wrapping article 10 is, as shown in FIGS. 1–3, constructed having a pocket-shaped hood or hood means 20 formed at or connected (as by sewing a separate hood to sheet 13) to upper central regions of the article for receiving or fitting over the top of an infant's head 22 when infant 12 is resting on article 10 along centerline 14. Further, article 10 comprises foot means 24 formed at or connected to lower central regions of sheet 13 for receiving the feet of an infant 12 resting on article 10 along centerline 14. Preferably, as shown, foot means 24 comprise respective first and second booties or stocking feet 26 and 28, each of which is constructed and sized to receive corresponding one of infant 12's feet.

Means 30 are provided for releasably connecting together flaps 16 and 18 when they are wrapped up and over infant 12 resting along centerline 14 with its head in hood 20 and its feet in stocking feet 26 and 28. It is preferred, for convenience and infant safety that means 30 comprise one or more pairs of hook and loop fabric strips. For example, two, spaced apart, elongate strips 32 of loop fabric are sewn to the inside of left-hand side flap 16 near an outer end region 34 thereof and two mating strips 36 of hook fabric are sewn to the outside of fight-hand flap 18 near an outer end region 38 thereof. Strips 32 and 36 are located so that they overlap one another when side flaps 16 and 18 are wrapped up and over infant 12 so that portions of the flaps substantially overlap one another. By means 30, side flaps 16 and 18 are securely connected to one another.

The height, H, of article 10 is selected by a maker or purchaser of the article according to the height of an infant 12 for which the article is intended to be used, the height, H, being such that upper regions of the infant's head 22 are inside hood 20 and its feet are in stocking feet 26 and 28.

The wrapping of an infant 12 in article 10 is depicted in FIGS. 2 and 3. Infant 12 is laid down on sheet 13 so that hood 20 can be slipped over the infant's head 22. The infant's feet are tucked into stocking feet 26 and 28. Then, right-hand side flap 18 is wrapped up and over central regions of infant and left-hand side flap 16 is wrapped up and over the infant so that such flap overlaps flap 18. Hook and loop strips 32 and 34 are pressed together so that infant 12 is securely wrapped in article 10.

An important advantage of providing hood 20 and foot means 24 (that is, stocking feet 26 and 28) is hat when infant 12 is wrapped in the above-described manner, the hood and foot means prevent the infant from slipping in either axial direction from the article. Moreover, hood 20 keeps the infant's head 22 warm and provides at least some protection therefor against accidental knocking.

Although there is described above a specific arrangement of an infant wrapping article in accordance with the present invention for the purpose of illustrating the manner in which the invention may be used to advantage, it will be appreciated that the invention is not limited thereto. Accordingly, any and all variations and modifications which may occur to those skilled in the art are to be considered to be within the scope and spirit of the invention as defined in the appended claims.

What is claimed is:

1. An article for wrapping an infant, the article comprising a sheet of fabric material having a left-hand side flap, a right-hand side flap, foot means at lower regions of the sheet for receiving the feet of an infant, and hood means in upper regions of the sheet for receiving portions of the head of an infant, said side flaps each having a sufficient sideward length to enable the flaps to wrap sidewardly over an infant resting along a vertical center region of the sheet and to overlap one another by a substantial amount, said left-hand and said right-hand side flaps being generally triangular in shape and being transversely aligned with one another, and including means for releasably securing said side flaps together when they are in said overlapped condition, said foot means comprising first and second stocking feet or booties each of which is configured for receiving a foot portion of an infant resting along said vertical center region of the sheet.

2. The infant wrapping article as claimed in claim 1, wherein said article is sized so that an infant is substantially prevented from slipping from the article when wrapped therein.

3. The infant wrapping article as claimed in claim 1, wherein said sheet is constructed of a material selected from the group of materials consisting of blanket material, bunting, quilting, and combinations thereof.

4. An article for wrapping an infant, the article comprising a sheet of fabric material having a generally triangular left-hand side flap, a generally triangular right-hand side flap, first and second booties or stocking feet depending from lower regions of the sheet for receiving the feet of an infant resting along a vertical central region of the sheet, and a hood at upper regions of the sheet configured for receiving portions of the head of said infant, said side flaps each having sufficient sideward length to enable the flaps to wrap sidewardly over said infant resting along the vertical center region of the sheet and to overlap one another by a substantial amount, and including means for releaseably securing said side flaps together when they are in said overlapped condition.

5. The infant wrapping article as claimed in claim 4, wherein said sheet is sized so that an infant resting along said vertical region of the sheet can have its head in said hood and its feet in said booties or stocking feet.

* * * * *